United States Patent [19]

Mizutani et al.

[11] Patent Number: 4,806,977

[45] Date of Patent: Feb. 21, 1989

[54] IMAGE FORMING APPARATUS WITH DISCONNECTABLE CARRIAGE DRIVE

[75] Inventors: Morikazu Mizutani, Tokyo; Shigeyoshi Onoda, Yokohama; Isao Ikemoto, Kawasaki; Shinji Kanemitsu, Tokyo; Hajime Kitajima, Yokohama, all of Japan

[73] Assignee: Canon Kabushiki Kaisha, Tokyo, Japan

[21] Appl. No.: 61,166

[22] Filed: Jun. 12, 1987

[30] Foreign Application Priority Data

Jun. 18, 1986 [JP] Japan ..... 61-143927
Jun. 24, 1986 [JP] Japan ..... 61-096081[U]
Jun. 24, 1986 [JP] Japan ..... 096082[U]

[51] Int. Cl.[4] ..... G03G 15/00
[52] U.S. Cl. ..... 355/8; 355/50
[58] Field of Search ..... 355/8, 3 R, 3 DR, 50, 355/51, 75

[56] References Cited

U.S. PATENT DOCUMENTS 3,993,406 11/1976 Zeuthen ..... 355/8
4,114,998 9/1978 Shimiza et al. ..... 355/3 DR
4,129,374 12/1978 Uehida et al. ..... 355/8
4,500,195 2/1985 Hosono ..... 355/3 R
4,538,896 9/1985 Tajima et al. ..... 355/3 R
4,588,280 5/1986 Ogawa et al. ..... 355/3 R
4,609,276 9/1986 Mitzutani ..... 355/3 R
4,609,277 9/1986 Yokoyama et al. ..... 355/3 R
4,671,649 6/1987 Schiemann et al. ..... 355/8 X

FOREIGN PATENT DOCUMENTS 52-54633 4/1977 Japan .
60-88933 5/1985 Japan ..... 355/8
62-3802 1/1987 Japan .

*Primary Examiner*—A. T. Grimley
*Assistant Examiner*—J. Pendegrass
*Attorney, Agent, or Firm*—Fitzpatrick, Cella, Harper & Scinto

[57] ABSTRACT

An image forming apparatus having first body portion and a second body portion that swings into and out from the first body portion and a rack and pinion drive arrangement mounted on the first body portion for driving a carriage over an optical system on the second body portion when it is swung into the first body portion. The rack and pinion are disengaged when the carriage is moved away from the optical system to allow the second body portion to swing out from first body portion; and the rack and pinion have a flexible flange or specially shaped teeth to provide proper positioning of the pinion for smooth reengagement.

14 Claims, 6 Drawing Sheets

IMAGE FORMING APPARATUS WITH DISCONNECTABLE CARRIAGE DRIVE

BACKGROUND OF THE INVENTION

1. Field of the Invention

This invention relates to an image forming apparatus of the type in which a carriage for carrying an original image is moved reciprocally over an optical system and more particularly relates to novel carriage mounting and drive arrangements which facilitate opening the apparatus for repair or replacement of parts.

2. Description of the Related Art

U.S. Pat. Nos. 4,500,195, 4,538,896, 4,588,280 and 4,609,276 and Japanese Utility Model Laid Open Application No. 52-54633 disclose image formation devices, such as electrophotographic copying machines, which have a moveable carriage for reciprocally moving a document to be copied in a horizontal direction over a scanning slit in the body of the machine. The bodies of the machines shown in these patents are divided into an upper body portion and a lower body portion and the upper body portion swings to from the lower body portion, like the opening of a clamshell, to provide access to the internal mechanism of the machine for cleaning, adjustment or repair, or to free jammed paper.

In the above identified U.S. patents the moveable carriage is mounted on the upper body portion; and therefore the carriage and its supporting and driving mechanism must be swung up together with the upper body portion when the machine is opened. Because of this the upper body portion must be large and of heavy construction; and a large spring or other actuating means must be provided for opening and holding the upper body portion in its opened position. The Japanese Utility Model shows a copying machine having a moveable carriage and an optical system mounted in the main body portion. Only the photosensitive drum of this copying machine is mounted on the second or moveable body portion. This means that when the moveable body portion is swung upwardly, it provides very little access to the internal components.

In addition, these known image forming apparatus of the type shown in the above-mentioned U.S. patents and Japanese Utility Model suffer from the following disadvantage. Namely, in these known apparatus, there is a risk that the carriage accidentally moved when the apparatus is in the open state, due to an erroneous operation of the carriage driving system of the apparatus.

SUMMARY OF THE INVENTION

Accordingly, an object of the present invention is to provide an image forming apparatus which is improved in such a manner as to prevent the carriage from being driven when the apparatus is in open state, even if the carriage driving motor is operating.

This invention overcomes the above described problems of the related art. More specifically, the present invention provides an image forming apparatus having a compact and light weight swingable body portion which, when swung upwardly, provides good access to the internal components. The invention also provides novel disconnectable carriage drive mechanisms for a scanning type image forming apparatus.

According to one aspect of the invention, there is provided an image forming apparatus of the type in which a carriage for carrying an original image is moved reciprocally over an optical system and in which body of the apparatus is divided into a first body portion and a second body portion with different internal components supported by each portion. The second body portion is mounted to swing out from the first body portion to provide access to the internal components. The optical system is mounted in this second body portion. Means are provided to mount the carriage on the first body portion for reciprocal scanning movement over the optical system when the second body portion is swung in to the first body portion. A drive mechanism is provided to move the carriage in its scanning operation. This drive mechanism is disconnectable to enable the carriage to be moved away from the optical system and to allow the second body portion to swing out from the first body portion.

According to a further aspect of the invention there is provided, in a moveable carriage type image forming apparatus, a disconnectable carriage driving mechanism comprising a rack and pinion arranged between the carriage and the body of the apparatus. The rack extends over a distance such that the pinion remains in engagement with the rack during scanning movement of the carriage over the optical system of the apparatus. The rack however, terminates at a location such that the pinion comes out of engagement with the rack when the carriage is moved beyond the optical system. The rack and pinion are constructed and arranged such that when the carriage is moved back to the optical system the pinion is brought smoothly into meshing engagement with the pinion.

DETAILED DESCRIPTION OF THE PREFERRED EMBODIMENT

Figure 1:
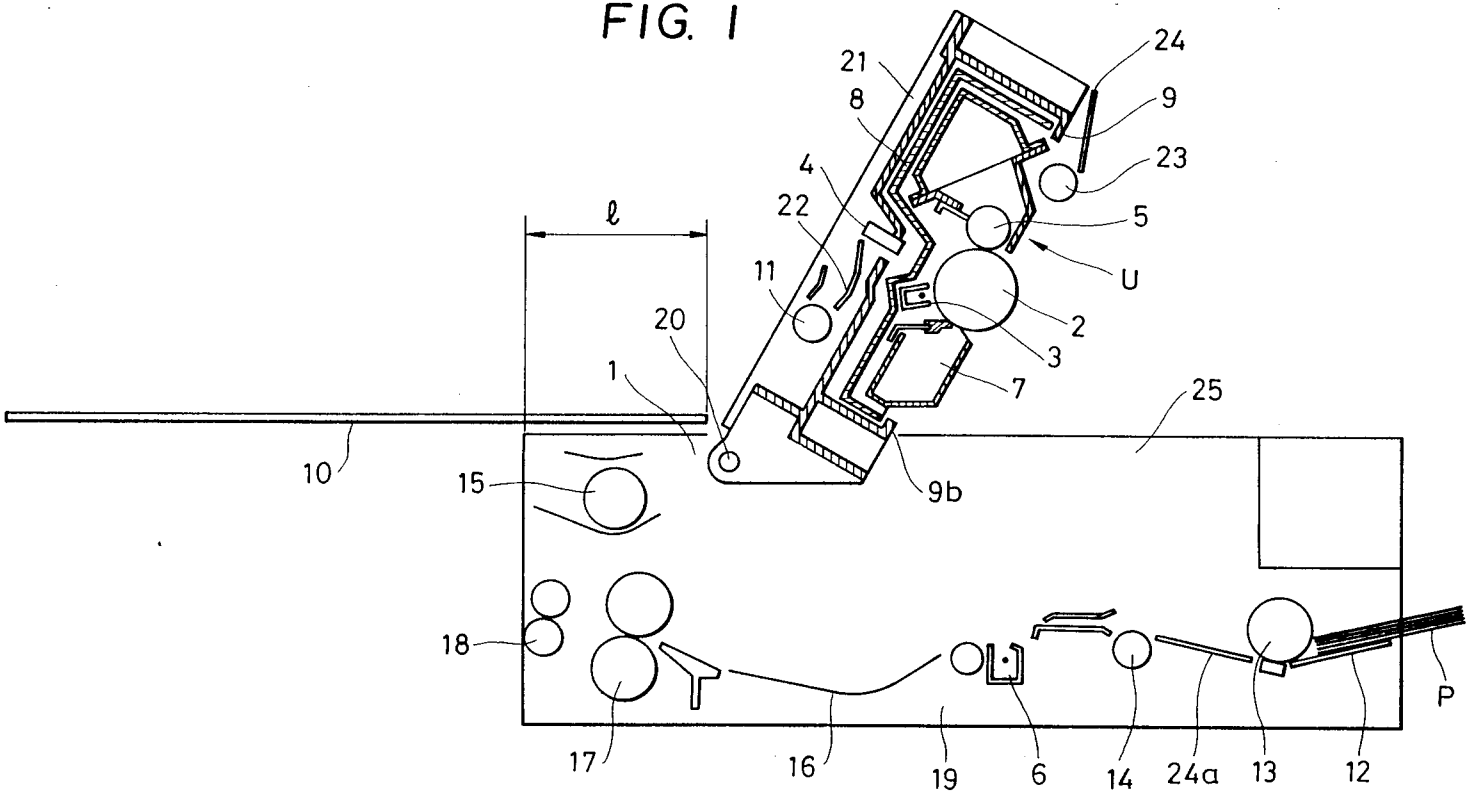
FIG. 1 is a diagrammatic cross-sectional view of an opened copying apparatus in which the present invention is embodied.
Figure 2:
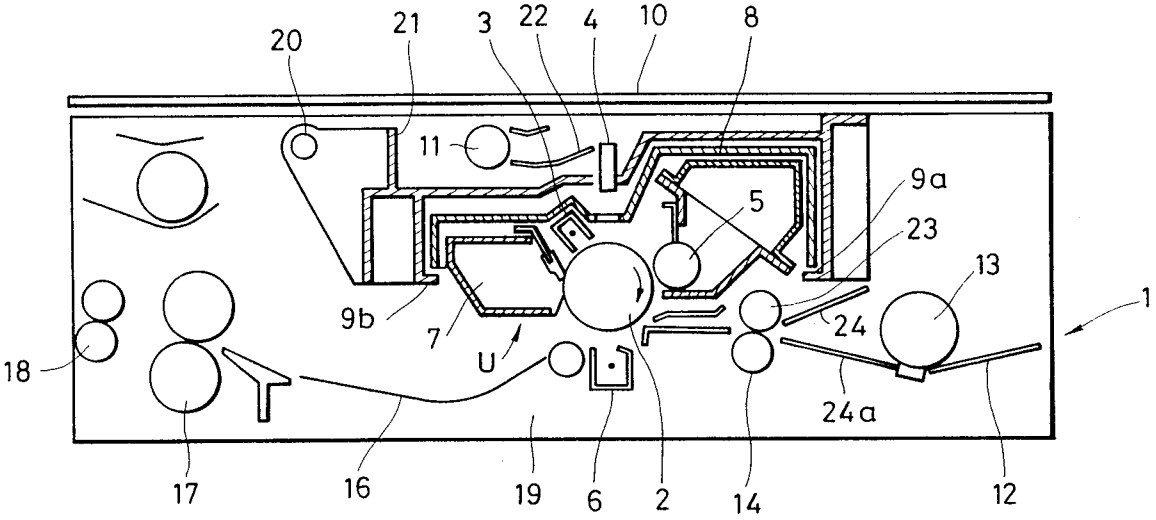
FIG. 2 is a view similar to FIG. 1 but showing the copying apparatus in its closed condition.
Figure 3:
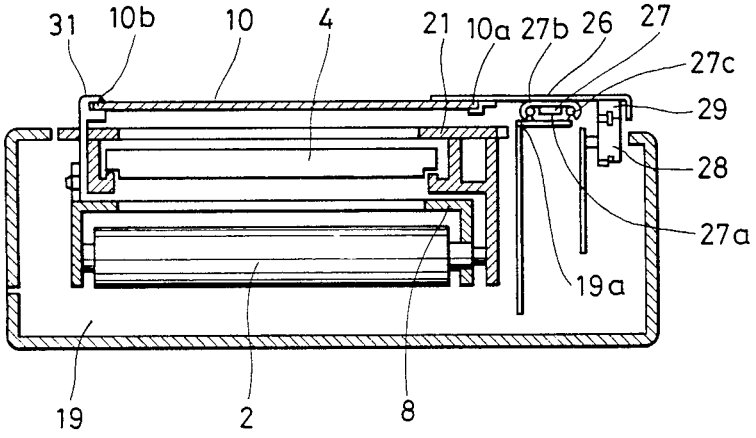
FIG. 3 is a view taken along line 3—3 of FIG. 2.

The copying apparatus shown in FIGS. 1–3 comprises a box-shaped lower body portion 19 and a swingable upper body portion 21 which is connected at one end to a pivot 20 so that it can swing in clamshell fashion from an open position as shown in FIG. 1 to a closed position as shown in FIG. 2. The lower body portion 19 has an opening 25 in its upper surface into which the upper body portion 21 extends when it is in a closed position.

The upper body portion 21 has contained therein a rotatably mounted photosensitive drum 2; and, arranged around the drum in the direction of its rotation, a corona charger 3, a short focus optical array 4, a developing device 5 and a cleaner 7. These elements are all packaged together in one integral process unit U which is supported by guide rails 9*a* and 9*b* of the upper body portion. The guide rails allow the unit U to be removed from the apparatus by sliding out in a direction perpendicular to the plane of the drawing when the upper body portion 21 is opened as shown in FIG. 1.

There is also provided in the upper body portion 21, a fluorescent lamp 11 and a light guide or mirror 22 to illuminate a document to be copied as it moves across the optical array 4. In addition, the upper body portion 21 contains an upper sheet guide 24 and an upper register roller 23. The upper register roller 23 is driven by roller drive means (not shown) in synchronism with the drum 2.

A transparent carriage 10 is mounted on the lower body portion 19 to move reciprocally over the optical array 4 when the upper body portion 21 is closed as shown in FIG. 2.

In operation of the apparatus, a document to be copied is placed, with its image surface facing downward, on the carriage 10 and the carriage is driven reciprocally in a horizontal direction so that the document passes over the optical array 4. At the same time, the drum 2 is rotated in a clockwise direction, as shown in FIG. 2, in synchronism with the movement of the carriage 10 across the optical array 4. As the drum 1 rotates, its photosensitive surface 2 is uniformly charged to a predetermined polarity by the corona charger 3. The charged photosensitive surface of the drum 2 then passes under the optical array 4 where it moves in synchronism with the carriage 10. Light from the fluorescent lamp 11, is reflected off the image of the document on the carriage and passes through the optical array 4 which directs it on to the photosensitive surface of the rotating drum to selectively discharge the surface and thereby form a latent electrostatic image on the drum. As the drum 2 rotates, this electrostatic image passes by the developer 5 which deposits toner onto the charged regions of the image. The thus developed image is then transferred by the action of a transfer charger 6 onto a paper sheet P which moves along with the surface of the drum.

The lower body portion 19 of the copying apparatus contains a sheet tray 12 at one end thereof. This tray holds a stack of the paper sheets P. A feeding roller 13 is also mounted in the lower body portion 19 and operates to separate individual sheets P from the stack and feed then individually between the upper guide 24 and a lower guide 24*a* to the nip formed between the register roller 23 and a press roller 14. The press roller 14 is mounted in the lower body portion 19 and cooperates with the register roller 23 to move the paper sheets P into contact with the developed portion of the drum 2 and to move in synchronism therewith past the transfer charger 6 to transfer the toner image from the drum surface to the paper. The paper sheet P then passes from the drum to a guide 16 and on toward a fixing device 17 which causes the toner image to be permanently fixed on the paper sheet. The paper sheet then is discharged out from the apparatus by means of discharge rolls 18.

The paper transfer portions of the apparatus, including the sheet tray 12, the feeding roller 13, the lower guide 24*a* the press roller 14, the transfer charger 6, the guide 16, the fixing device 17 and the discharge rolls 18, are all mounted in the lower body portion 19 of the apparatus and thus are exposed for repair or paper jam clearance whenever the upper body portion 21 is swung upwardly as shown in FIG. 1.

The mounting of the carriage 10 is shown in FIG. 3. One edge 10*a* of the transparent portion of the carriage is secured to a supporting member 26 which in turn is slidably mounted on a precision ball bearing slide 27. The ball bearing slide 27 is of conventional construction and comprises a lower stationary track 27*a*, which is affixed to and extends along an upper surface 19*a* of the lower body portion 19, an upper track 27*b*, which is affixed to the underside of the supporting member 26, and a plurality of ball bearings 27*c* contained in a bearing retainer (not shown). The ball bearings ride between the two tracks and allow smooth and precise movement of the carriage 10 in the direction of the slide 27.

The edge 10*b* of the carriage 10 which is opposite the supporting member 26 is guided by a groove formed in a slide member 31 in the upper body portion 21.

Figure 4:
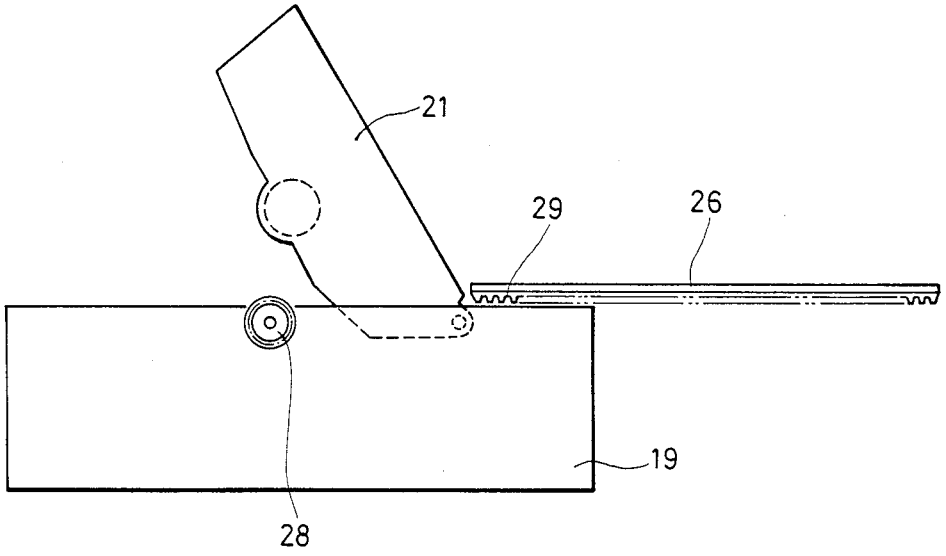
FIG. 4 is a view taken along line 4—4 of FIG. 3 but showing the apparatus in its opened condition.

In order to move the carriage 10 reciprocally over the optical array 4 during scanning, there is provided a drive motor (not shown) which is arranged to turn a pinion gear 28 mounted in the upper region of the lower body portion 19 as shown in FIGS. 3 and 4. When the carriage 10 is positioned in its scanning range, the pinion 28 meshes with a rack 29 which is affixed to the underside of the supporting member 28 and extends alongside the slide 27. As can be seen in FIG. 4, the pinion gear 28 is mounted near the center of the bottom portion 19 so that it can engage with and drive the rack 29 and carriage 10 back and forth over the optical array in the upper portion 21 during normal operation; but when the carriage 10 is moved to the extreme right, as shown in FIG. 4 for swinging open the upper portion 21, the rack 29 comes out of engagement with the pinion 28.

As shown in FIG. 1, whenever the upper body portion 21 is opened, the carriage 10 is first shifted leftwardly, as viewed in the drawing, beyond the optical array 4 and beyond the entire upper body portion 21 so as to allow the upper body portion 21 to swing upwardly as shown. As can be seen, the process unit U, including the photosensitive drum 2, the corona charger 3, the developing device 5 and the cleaner 7, can be removed from the upper body portion by sliding the unit out in a direction perpendicular to the plane of the drawing.

In order to provide proper support for the carriage 10 when it is moved beyond its scanning range to the position shown in FIG. 1 for allowing the second or upper body portion 21 to be opened, the lower body portion 19 extends beyond the left end of the upper body portion 21 (as viewed in FIG. 1) by a distance 1. The upper surface of the lower body portion 19 in the region of the distance 1 provides support for the carriage 10 in this position and the slide 27 keeps it from tipping off from the machine. Suitable stops (not shown) are built into the slide 27 for limiting the maximum movement of the carriage 10 along the slide. A suitable ball bearing slide and stopper assembly is sold under the trademark ACCURIDE RAIL by Accuride Japan Co., Ltd., Neyagawa-shi Japan and is described in Japanese published Utility Model 62-3802.

During normal operation of the machine the pinion gear 28 remains meshed with the rack 29 and drives the carriage support 26 and the carriage 10 reciprocally past the optical array 4. when, however, it is desired to open the machine by pivoting up the upper body portion 21 as shown in FIG. 1, to replace the unit U or to free a jammed sheet of paper, the carriage 10 is first moved to the extreme left as viewed in FIG. 1. This allows the upper body portion 21 to swing up without interference by the carriage 10. Because both the carriage 10 and the supporting member 26 are moved away from the upper body portion 21 at the time the upper body portion swings upwardly; they do not contribute to the weight of the upper body portion. Also, because the carriage 10 and the supporting member 26 are free of the upper body portion 21, they may be moved freely and without interference or danger of accident or glass breakage. Further, the above described arrangement also makes it possible to shorten the distance between the center of gravity of the upper body portion 21 and the pivot 20 so that the strength of the spring or other means used for holding the upper body portion in its opened condition may be minimized. This reduction in size and weight of the upper body portion also permits it to be made of less costly materials, such as plastic, since special reinforcing is not needed.

When the carriage 10 is moved to its extreme leftward position as viewed in FIG. 1 for permitting the upper body portion 21 to open, the rack 29 on the support 26 moves beyond, and out of engagement with, the pinion gear 28. Thus, even if the pinion gear should continue or begin to rotate it will have no effect on the carriage 10 and the carriage remains free from possibly dangerous driving forces when the upper body portion is open. As is clear from the foregoing, the pinion gear 28 and the rack 29 together form part of a driving means for the carriage; and a driving power path thus extends through the pinion and rack and is adapted to be mechanically opened when the carriage is retracted.

Thereafter, when the upper body portion 21 is reclosed as shown in FIG. 2, the carriage 10 and support 26 can be pushed back (rightwardly as viewed in FIG. 2) by hand until the rack 29 comes back into engagement with the pinion 28. Thereafter the pinion will operate to move the rack, support and carriage reciprocally through a scanning range so that documents on the carriage are scanned across the optical array 4.

The present invention provides novel arrangements for smoothly reengaging the teeth of the rack 29 with those of the pinion 28 when the carriage 10 is returned from the position shown in FIG. 1 to its normal operating position shown in FIG. 2.

Figure 5A:
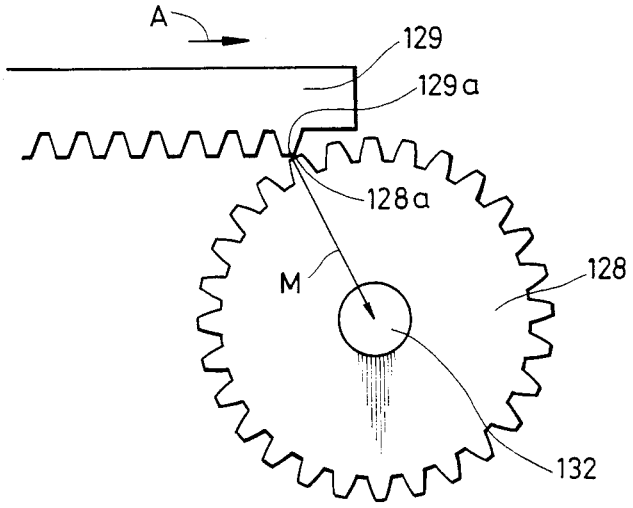
FIGS. 5A and 5B are side views respectively of disengaged and engaged rack and pinion arrangements employed in the apparatus of the present invention.

FIG. 5A shows a prior art rack 129 having teeth **129*a* out of engagement with teeth 128*a* of a pinion gear 128. The rack 129 is movable in the direction of an arrow A toward meshing engagement of its teeth 129*a* with the teeth 128*a* of the pinion 128**.

Figure 5B:
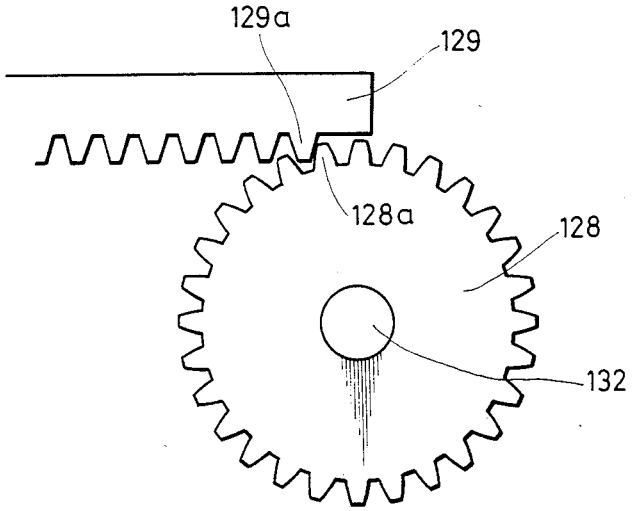

When the rack and pinion teeth are in proper engagement, as shown in FIG. 5B, rotation of the pinion 128 about its axis 132 will smoothly drive the rack 129 in the direction of the arrow A. However, as shown in FIG. 5A when the pinion 128 is at a rotational position such that the tip of one of its teeth **128*a* is in the path of movement of the tip of the first rack tooth 129*a*, the rack tooth will contact the pinion in an interfering manner. That is, the force produced by the rack moving in the direction of the arrow A will be directed essentially in the direction of the arrow M, i.e. through the axis 132** of the pinion. Almost no force will be produced tangentially of the pinion and it will be unable to rotate. As a result the machine would jam and become inoperative.

Figure 6:
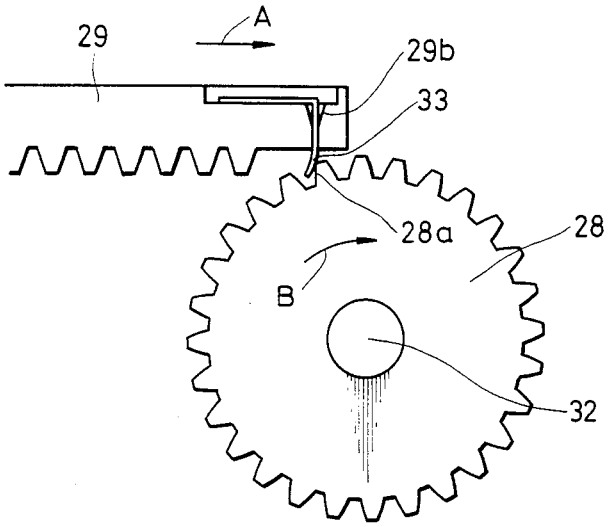
FIG. 6 is a side view of an improved carriage drive rack and pinion arrangement according to the present invention.
Figure 7:
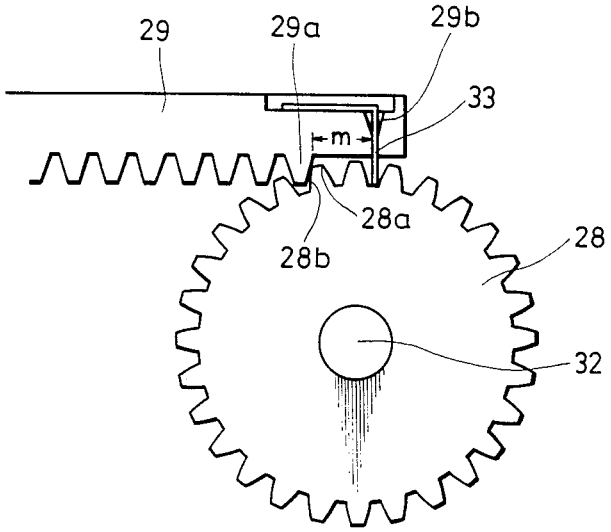
FIG. 7 is an enlarged fragmentary view showing tooth engagement of the rack and pinion arrangement of FIG. 6.

FIGS. 6 and 7 show a preferred arrangement according to the present invention for avoiding the above described jamming problem of prior art rack and pinion arrangements. As shown in FIG. 6 there is provided on the rack 29, at a short distance ahead of the first rack tooth **29*a*, a flexible flange 33. The flange 33 may be made from any resilient material, such as polyester film; and it may be bonded to the upper portion of the rack 29 in a manner such that a free end of the flange 33 projects down through a slot 29*b* of the rack by an amount substantially equal to the height of the rack teeth 29*a***.

When, as shown in FIG. 6, the rack 29 is moved in the direction of the arrow A toward the pinion 28, the flange 33 will initially engage one of the teeth **28*a* of the pinion. Because of the resilience of the flange 33 it can bend to accommodate the pinion tooth 28*a* at any position of the tooth and thereby produce a rotational force on the pinion. As the rack continues to move in the direction of the arrow A the flange will straighten to its normal position as shown in FIG. 7 thereby causing the pinion to rotate in the direction of the arrow B (FIG. 6) a little faster than the rack movement so that the pinion is in proper position for meshing engagement with the first rack tooth 29*a*. Thus the rack 29 can be brought into smooth meshing engagement with the pinion 28**.

If the position of the pinion gear **28*a* is such that the flexible flange 33 cannot produce a rotational force on the pinion, then continued movement of the rack 29 in the direction of the arrow A will simply cause the flexible flange 33 to bend and pass over the pinion tooth 28*a*. The flange 33 will then enter the space on 28*b* the opposite side of that tooth and will straighten out as shown in FIG. 7** to bring the pinion into proper rotational position for smooth meshing with the rack as described above.

The flange 33 may be of any suitable resilient material including rubber, plastic material or the like. However, thus material should be flexible enough to pass over the pinion tooth **28*a*** and yet strong enough to turn the pinion to a proper meshing position.

As shown in FIG. 7, the flexible flange 33 is positioned at a distance m ahead of the first rack tooth **29*a*. The distance m should correspond to the pitch of the rack nd pinion teeth and should be equal to some integer (preferably two or more) times the pitch distance. The distance should be great enough to enable the flexible flange 33** to bring the pinion into proper rotational position but it should not be so great that the flange has gone out of engagement with the pinion before the first rack tooth comes into engagement with the pinion.

Figure 8:
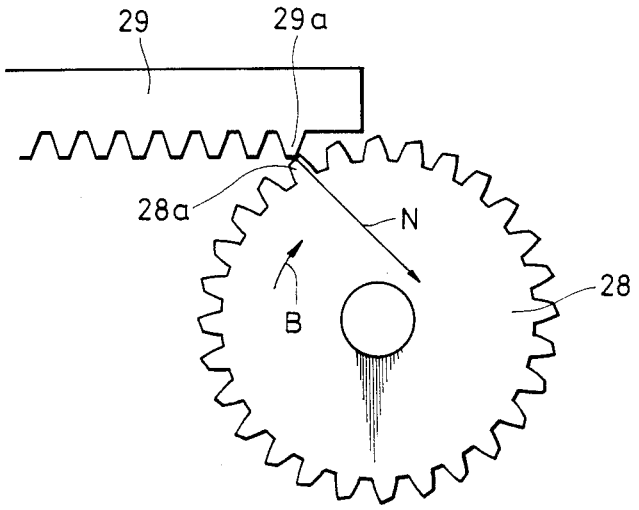
FIG. 8 is a side view showing, in disengaged condition, an improved carriage drive rack and pinion arrangement according to the present invention.
Figure 9:
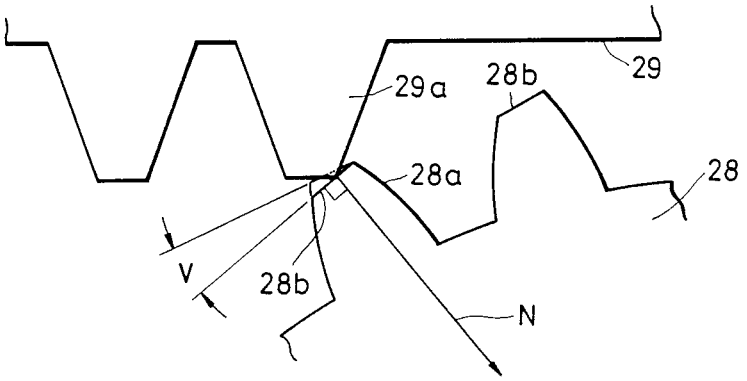
FIG. 9 is a view similar to FIG. 8 but showing the rack and pinion arrangement in engaged condition.

FIGS. 8 and 9 show an alternate arrangement according to the present invention for avoiding jamming when the rack 29 is brought into engagement with the pinion 28. As shown in FIG. 9, the pinion 28 has teeth **28*a* with tip surfaces 28*b* which are oriented at an angle V from a tangent to the pinion. As a result of this reorientation of the tooth tip surface, any forces imposed on the pinion 35 by movement of the rack 29 are redirected, as shown by the arrow N so that they do not pass though the axis 32 (FIG. 8) of the pinion. Instead, the line of force at initial tooth contact extends from the point of contact in a direction between the path of movement of the rack and the center of rotation of the pinion. Thus a substantial tangential force is imposed on the pinion which allows it to rotate in the direction of the arrow B (FIG. 8) ahead of the rack movement so that its teeth can come into smooth meshing engagement with the rack teeth Although in the above described embodiment the tips 28*b*** of the pinion teeth are at an angle relative to the target of the pinion, it is possible to provide modifications wherein the pinion tooth tip surfaces are curved in a manner such that the pushing force of the rack teeth is directed above the rotational axis of the pinion. Also it is possible to provide a suitable tip angle or curvature on the ends of the rack teeth to redirect the initial engaging force in a direction above the rotational axis of the pinion.

With the arrangement of the present invention the rack and pinion can easily be disengaged to enable the machine to be opened and can be smoothly and easily reengaged without damage to any part of the carriage drive mechanism. This is especially advantageous in the case of an image processing apparatus having a movable original carriage.

While the invention has been described with reference to the embodiments disclosed herein, it is not confined to the details set forth and the present application is intended to cover such modifications and changes as may come within the spirit of the disclosure and the scope of the claims.

What is claimed is:

1. An image forming apparatus of the type in which a carriage for carrying an original image is moved reciprocally over an optical system and in which a body of the apparatus is divided into a first body portion and a second body portion with different internal components supported by each portion, the second body portion being mounted to swing out from the first body portion to provide access to said internal components, said optical system being mounted on said second body portion, means mounting said carriage on said first body portion and a drive mechanism arranged to move said carriage reciprocally across said optical system when said second body portion is swung into said first body portion, said drive mechanism being disconnectable to enable said carriage to be moved away from said optical system and allow said second body portion to swing out from said first body portion.

2. An image forming apparatus according to claim 1 wherein said means mounting said carriage on said first body portion includes means for guiding said carriage for reciprocal movement over said optical system and for guiding said carriage beyond said optical system to allow said second body portion to swing out from said first body portion.

3. An image forming apparatus according to claim 2 wherein said means mounting said carriage includes a ball bearing slide.

4. An image forming apparatus according to claim 2 wherein said drive mechanism comprises a rack and pinion assembly.

5. An image forming apparatus according to claim 4 wherein said rack and pinion assembly is arranged to remain in engagement during movement of said carriage over said optical system and to come out of engagement upon movement of said carriage beyond said optical system.

6. An image forming apparatus according to claim 5 wherein said rack and pinion arrangement is constructed and arranged such that when the carriage is moved back to said optical system the pinion is rotated into meshing engagement with said rack.

7. An image forming apparatus according to claim 6 wherein said rack is provided with a flexible flange at an end thereof to come into engagement with said pinion before the teeth of said rack contact the teeth of said pinion when said carriage is moved back to said optical system so that said flange engages the teeth of said pinion and brings the pinion into meshing position with respect to the teeth of said rack.

8. An image forming apparatus according to claim 6 wherein said rack and pinion have teeth which are configured to develop, upon initial contact at any rotational position of said pinion, a line of force extending from the point of contact in a direction between the path of movement of said rack and the center of rotation of the pinion.

9. An image forming apparatus according to claim 1 wherein said second body portion contains a process unit which is removable therefrom.

10. An image forming apparatus according to claim 9 wherein said process unit contains an electrophotographic drum, an electrostatic charger, a developing device and a drum cleaner.

11. In an image forming apparatus of the type in which a carriage for carrying an original image is moved reciprocally over an optical system and wherein the carriage is movable beyond the optical system to allow access to the interior of the apparatus, a disconnectable carriage driving mechanism comprising a rack and a pinion arranged one on the carriage and the other on a body of the apparatus, the rack extending over a distance such that said pinion remains in engagement with the rack during movement of the carriage over the optical system but terminating at a location such that the pinion comes out of engagement with the rack when the carriage is moved beyond the optical system, said rack and pinion being constructed and arranged such that when said carriage is moved back to said optical system said pinion is brought into position for proper meshing engagement with said rack.

12. An image forming apparatus according to claim 11 wherein said rack is provided with a flexible flange at an end thereof to come into engagement with said pinion before the teeth of said rack contact the teeth of said pinion when said carriage is moved back to the optical system so that the flange engages the teeth of said pinion and brings the pinion into meshing position with respect to the teeth of said rack.

13. An image forming apparatus according to claim 11 wherein said rack and pinion have teeth which are configured to develop, upon initial contact at any rotational position of said pinion, a line of force extending from the point of contact in a direction between the path of movement of said rack and the center of rotation of the pinion.

14. An image forming apparatus comprising:

a first body portion;

a second body portion, said second body portion and said first body portion being movable relative to each other so as to selectively establish an open state of said apparatus;

a carriage carrying an original and movable between a home position and a retracted position, said carriage being adapted to prevent relative movement of said first and second body portions into said open state of said apparatus but allows said relative movement when it is in said retracted position, thus enabling said apparatus to be opened; and driving means for driving said carriage and having a driving power path which is adapted to be mechanically opened when said carriage is in said retracted position.

* * * * *

UNITED STATES PATENT AND TRADEMARK OFFICE

CERTIFICATE OF CORRECTION

PATENT NO. : 4,806,977

DATED : February 21, 1989

INVENTOR(S) : MORIKAZU MIZUTANI, ET AL.

It is certified that error appears in the above-identified patent and that said Letters Patent is hereby corrected as shown below:

IN [30] FOREIGN APPLICATION PRIORITY DATA

"Japan ..... 096082[U] should read
--Japan .....61-096082[U]--.

COLUMN 1

Line 23, "to" should read --out--.
Line 47, "moved" should read --moves--.

COLUMN 2

Line 30, "pinion." should read --rack.--.

COLUMN 3

Line 37, "lamp 11," should read --lamp 11--.
Line 53, "then" should read --them--.
Line 68, "guide 24a" should read --guide 24a,--.

COLUMN 4

Line 29, "supporting member 28" should read
--supporting member 26--.
Line 68, "when," should read --When,--.

UNITED STATES PATENT AND TRADEMARK OFFICE

CERTIFICATE OF CORRECTION

PATENT NO. : 4,806,977

DATED : February 21, 1989

INVENTOR(S) : MORIKAZU MIZUTANI, ET AL.

It is certified that error appears in the above-identified patent and that said Letters Patent is hereby corrected as shown below:

COLUMN 6

Line 38, "thus" should read --this--.
Line 44, "nd" should read --and--.
Line 58, "ion 35" should read --ion 28--.

COLUMN 7

Line 3, "target" should read --tangent--.

Signed and Sealed this

Eleventh Day of September, 1990

*Attest:*

HARRY F. MANBECK, JR.

*Attesting Officer*

*Commissioner of Patents and Trademarks*